United States Patent [19]

Sakamoto et al.

[11] Patent Number: 4,507,669

[45] Date of Patent: Mar. 26, 1985

[54] THERMOSENSITIVE RECORDING SHEET

[75] Inventors: Hiroshi Sakamoto; Yoshihiro Koseki; Takanori Motosugi; Norihiko Inaba, all of Namazu, Japan

[73] Assignee: Ricoh Company, Ltd., Tokyo, Japan

[21] Appl. No.: 461,812

[22] Filed: Jan. 28, 1983

[30] Foreign Application Priority Data

Feb. 5, 1982 [JP] Japan ..... 57-17071

[51] Int. Cl.[3] ..... B41M 5/18

[52] U.S. Cl. ..... 346/207; 346/200; 346/208; 346/209; 346/214; 346/226; 428/913

[58] Field of Search ..... 282/27.5; 346/200, 207, 346/214, 226, 208–212, 216; 428/320.8, 323, 327, 328, 331, 411, 488, 537, 913, 914, 411.1, 488.1, 537.5

[56] References Cited

U.S. PATENT DOCUMENTS 4,388,362 6/1983 Iwata et al. ..... 428/331

FOREIGN PATENT DOCUMENTS 0086789 6/1980 Japan ..... 346/226

0140590 11/1980 Japan ..... 346/207

0027394 3/1981 Japan ..... 346/226

*Primary Examiner*—Bruce H. Hess

*Attorney, Agent, or Firm*—Flynn, Thiel, Boutell & Tanis

[57] ABSTRACT

A thermosensitive recording sheet comprising a support material; a primer layer formed on support material, comprising a filler and a binder agent; a thermosensitive coloring layer formed on the primer layer, comprising a colorless or light-colored leuco dye, and an acidic material which colors the leuco dye upon application of heat thereto; and a protective layer formed on the thermosensitive coloring layer, comprising a water-soluble polymeric binder agent and a filler. This thermosensitive recording sheet has high dynamic thermal coloring sensitivity and is capable of yielding sharp images with high image density at low energy consumption with good thermal-head-matching properties such that materials are not generated which come out of the thermosensitive recording layer and adhere to the thermal pen or head during the recording process, thereby causing the thermal pen or head to stick to the thermosensitive recording sheet.

17 Claims, No Drawings

THERMOSENSITIVE RECORDING SHEET

BACKGROUND OF THE INVENTION

The present invention relates to a thermosensitive recording sheet, and more particularly to a thermosensitive recording sheet comprising a support material; a primer layer formed on the support material, comprising a filler and a binder agent; a thermosensitive coloring layer formed on the primer layer, comprising a colorless or light-colored leuco dye, and an acidic material which colors the leuco dye upon application of heat thereto; and a protective layer formed on the thermosensitive coloring layer, comprising a water-soluble polymeric binder agent and a filler, which thermosensitive recording sheet is particularly improved with respect to high speed coloring performance and thermal-head-matching properties.

It is conventionally known that a light-colored leuco dye reacts with an organic acidic material and is colored upon melting of the leuco dye and the acidic material under application of heat hereto.

Examples of thermosensitive recording sheets in which this reaction is applied are disclosed, for instance, in Japanese Patent Publications No. 43-4160 and No. 45-14039.

Recently, those thermosensitive recording sheets have been employed in a variety of fields, for instance, for use with recorders for measurement instruments and terminal printers for computers, facsimile apparatus, automatic ticket vending apparatus, and thermosensitive copying apparatus.

In accordance with recent remarkable improvements in the performance of the above-mentioned apparatus and the application thereof to a variety of new fields, there is a great demand for thermosensitive recording sheets which can complement those improved apparatus. More specifically, there are demanded thermosensitive recording sheets capable of yielding sharp images with high density at low energy consumption, for use with high-speed thermal pens or heads, without generating materials which adhere, for instance, in the form of particles, to the thermal pens or heads during the recording process when heat is applied to the recording sheets through the thermal pens or heads. In the case of conventional thermosensitive sheets, during the application of heat to the thermosensitive sheets by a thermal pen or head during thermal printing, materials contained in the thermosensitive coloring layer are fused and adhere, in the form of particles, to the thermal pen or head.

The particles then stick to the thermosensitive recording sheet itself and hinder the feeding thereof, or they are transferred back to the recording sheet, leaving trailing marks on the recording sheet. When the sticky particles accumulate on the thermal pen or head, image density and image sharpness tend to decrease, and images are deformed.

These conventional thermosensitive recording sheets are also slow in thermal response, not allowing rapid recording with high image density and high image sharpness.

In a thermosensitive recording sheet with a thermosensitive coloring layer comprising a leuco dye and an acidic material which colors the leuco dye upon application of heat thereto, the coloring is caused by either the leuco dye or the acidic material or both of them being fused by the thermal energy supplied by a thermal pen or head, followed by the reaction of the leuco dye and the acidic material to form a certain color.

In order to increase the thermal coloring sensitivity of the thermosensitive recording sheet, there have been proposed methods in which a thermo-fusible material is added to the thermosensitive coloring layer, which thermo-fusible material melts at a temperature lower than that the melting points of either the leuco dye or the acidic material, and is capable of melting both the leuco dye and the acidic material when melted.

Examples of such thermo-fusible materials are disclosed, for instance, in the following Japanese laid-open patent applications: nitrogen-containing compounds, such as acetamide, stearamide, m-nitroaniline, and phthalic acid dinitrile in Japanese Laid-Open Patent Application No. 49-34842; acetoacetanilide in Japanese Laid-Open Patent Application No. 52-106746; and alkylated biphenyls and biphenyl alkanes in Japanese Laid-Open Patent Application No. 53-39139.

Even methods of increasing the thermal coloring sensitivities of the thermosensitive recording sheets by use of the above-mentioned compounds, however, are not adequate with recently developed high-speed thermal heads, for instance, for new facsimile apparatus with increased transmission speeds. Furthermore in the case of high-speed thermal pens and heads, due to quick alternations of their energized and deenergized states, heat tends to accumulate around the thermal pen or head during thermal recording. As a result, the background of the thermosensitive recording sheet is also apt to be colored by the accumulated heat.

In order to prevent the coloring of the background area by the accumulated heat around the thermal pen or head, it is necessary to increase the thermal sensitivity of the thermosensitive recording sheet in such a manner that the recording sheet is colored with high contrast by a small temperature difference and at a high speed. This type of thermal sensitivity is referred to as dynamic thermal coloring sensitivity.

By use of the above-mentioned conventional thermo-fusible materials, the coloring initiation temperature of a leuco dye and an acidic material can be decreased when a heated thermal pen or head is in static contact with the thermosensitive recording sheet employing such thermo-fusible materials, thus, increasing the thermal sensitivity of the thermosensitive recording sheet. In contrast to the just mentioned dynamic thermal coloring sensitivity, this type of thermal sensitivity is referred to as static thermal coloring sensitivity.

The above-mentioned conventional thermo-fusible materials can increase the static thermal coloring sensitivity, but cannot always increase the dynamic thermal coloring sensitivity. When increasing the dynamic thermal coloring sensitivity by use of those thermal-fusible materials, it is necessary to add a large amount of the thermo-fusible materials to the thermosensitive coloring layer. However, when a large amount of the thermo-fusible materials is added to the thermosensitive coloring layer, materials contained in the thermosensitive coloring layer are apt to be fused and adhere to the thermal pen or head. Further, when a large amount of the thermo-fusible materials is added to the thermosensitive coloring layer, the coloring initiation temperature of the thermosensitive coloring layer so decreases that its preservability before use becomes poor in practice, with easy occurrence of fogging in the thermosensitive coloring layer.

When increasing the dynamic thermal coloring sensitivity of a thermosensitive recording sheet by other means, it is not always advisable, from the above-mentioned point of view, to decrease the coloring initiation temperature of the thermosensitive coloring layer.

In order, then, to increase the dynamic thermal coloring sensitivity, a method of increasing the smoothness of the surface of the thermosensitive coloring layer, and a method of decreasing the content of components which do not contribute to the thermal coloring reaction, such as fillers and binder agents, in the thermosensitive coloring layer, thereby relatively increasing the contents of the coloring material, have been proposed.

The surface of the thermosensitive coloring layer can easily be made smooth by subjecting the thermosensitive recording sheet to super-calendering. However, by that super-calendering, the surface appearance of the thermosensitive recording sheet is considerably impaired, for instance, with the background of the recording sheet colored or with the surface thereof becoming unpleasantly shiny.

Further, reduction in the amounts of fillers and binders is not always advisable. For example, in order to make the background of the thermosensitive recording sheet look white in color, and to prevent materials which adhere to the thermal pen or head from coming out of the thermosensitive coloring layer during the recording process, fillers, such as calcium carbonate, clay and urea-formaldehyde resin in the form of small particles; and water-soluble binder agents for binding the coloring components and other additives and fixing them to a support material, are added to the thermosensitive coloring layer. When the contents of these fillers and binder agents are reduced, as a matter of course, the above-mentioned objects of the addition of those fillers and binder agents cannot be attained. Consequently, the method of decreasing the content of the fillers and binder agents in the thermosensitive coloring layer is not effective, as a practical matter, for increasing the dynamic thermal coloring sensitivity.

SUMMARY OF THE INVENTION

It is therefore an object of the present invention to provide a thermosensitive recording sheet with high dynamic thermal coloring sensitivity, capable of yielding sharp images with high image density at low energy consumption, and with good thermal-head-matching properties such that materials are not generated which come out of the thermosensitive recording layer and adhere to the thermal pen or head during recording process, thereby causing the thermal pen or head to stick to the thermosensitive recording sheet.

The above-described object of the present invention is attained by a thermosensitive recording sheet comprising a support material; a primer layer formed on the support material, comprising a filler and a binder agent; a thermosensitive coloring layer formed on the primer layer, comprising a colorless or light-colored leuco dye, and an acidic material which colors the leuco dye upon application of heat thereto; and a protective layer formed on the thermosensitive coloring layer, comprising a water-soluble polymeric binder agent and a filler.

DETAILED DESCRIPTION OF THE PREFERRED EMBODIMENT

In a conventional thermosensitive layer, a thermosensitive coloring layer with a deposition ranging from about 3 g/m$^2$ to about 10 g/m$^2$ is formed on a sheet of high quality paper with a weight of 30 g/m$^2$ to 60 g/m$^2$. The surface of the high quality paper has undulations ranging from about 1 $\mu$m. Since the water-soluble coating liquid for the thermosensitive coloring layer easily penetrates the paper, it is extremely difficult to form the thermosensitive coloring layer in such a manner that a thermal head is always in uniform contact with the surface of the thermosensitive coloring layer. As a result, heat transfer from the thermal head to the thermosensitive coloring layer in the thickness direction thereof cannot be performed uniformly and effectively.

According to the present invention, the primer layer comprising as the main components a filler and a binder agent is formed on the conventional high quality paper. This primer layer is coated in such a manner that the undulations of the paper are completely covered to form a smooth base for the thermosensitive coloring layer to be formed on. The primer layer also serves to block the penetration of the components of the thermosensitive coloring layer into the support paper.

In the present invention, by the presence of this primer layer, the thermosensitive coloring layer can be formed with a predetermined uniform thickness and without the original formulation of the components of the thermosensitive coloring layer being changed during the coating process, since substantially no components of the thermosensitive coloring layer penetrate the base paper. As a result, the thermosensitivity of the thermosensitive coloring layer can be maintained high as originally intended.

According to the present invention, the amount of a filler in the primer layer coated on the high quality paper is preferably in the range from 2.0 g/m$^2$ to 30 g/m$^2$, with the average particle size of the filler being not more than 5 $\mu$m, and the amount of a binder agent contained in the primer layer preferably ranging from 10 wt. % to 50 wt. % of the total weight of the primer layer.

When the amount of the filler in the primer layer is less than 2.0 g/m$^2$, the undulations of the base paper are insufficiently leveled for the present invention, while, when the amount of the filler in the primer layer is more than 30 g/m$^2$, the primer layer is apt to peel off the support material.

Furthermore, it is preferable that the amount of the binder agent in the primer layer be in the range of 10 wt. % to 50 wt. %. When the amount of the binder agent is less than 10 wt. %, the binder agent does not work well for binding the filler, and, therefore, the components of the thermosensitive coloring layer penetrate the primer layer during the coating of the thermosensitive coloring layer, while, when the amount of the binder agent is more than 50 wt. %, the contribution of the primer layer to the increase of the thermal coloring sensitivity of the thermosensitive coloring layer decreases, possibly because, when the amount of the binder agent is more than 50 wt. %, the primer layer becomes too strong and repellent to all other binder agents, including those which may enter the primer layer from the thermosensitive coloring layer. That is, on the structural level, if the primer layer can accept some part of the binder agent contained in the thermosensitive coloring layer, in relative amounts of the coloring components—the leuco dye and the acidic material—increase in the thermosensitive coloring layer, consequently increasing the thermal coloring sensitivity of the thermosensitive coloring layer. However, if the primer layer is repellent to the binder agent contained in the thermosensitive coloring layer, that binder agent stays in the coloring layer, effectively diluting the coloring components.

The following fillers can be used for the present invention:

Inorganic fillers and organic fillers, which are conventionally employed for manufacturing paper or for coating paper, for example, calcium carbonate, clay, talc, silica, polystyrene resin, and urea-formaldehyde resin in the form of small particles.

As the binder agent for use in the primer layer, water-soluble polymers such as polyvinyl alcohol, cellulose ether, starch, ammonium polycarboxylates, and alkaline salts of isobutylene-maleic anhydride copolymer; and aqueous emulsions of styrene-butadiene latex, of styrene-acrylic acid ester, and of vinyl acetate can be employed. Of these binder agents, binder agents which become water-resistant after they are dried, such as ammonium polycarboxylates, and alkaline salts of isobutylene-maleic anhydride copolymer are most preferable for use.

In the present invention, the thermosensitive coloring layer formed on the above-described primer layer is significantly improved with respect to the dynamic thermal coloring sensitivity, as compared with the thermosensitive coloring layer of a conventional thermosensitive recording sheet.

The thermosensitive coloring layer according to the present invention comprises a leuco dye, an acidic material and a binder agent, and, if necessary, a thermo-fusible material and a filler.

It is preferable that the amount of the filler be not more than 3 times by weight the amount of the leuco dye, and that the amount of the binder agent be in the range of 3 to 10 wt. % of the total weight of the thermosensitive coloring layer.

The filler is not an indispensable component for the thermosensitive coloring layer. However, when it is added to the thermosensitive coloring layer, it does not have any adverse effect on the coloring of the thermosensitive coloring layer when the amount of the filler is not more than 3 times by weight the amount of the leuco dye in the thermosensitive coloring layer.

When the amount of the binder agent is less than 3 wt. % of the total weight of the thermosensitive coloring layer, the binding effect of the binder agent is insufficient for this thermosensitive recording layer, while, when the amount of the binder agent is more than 10 wt. % of the total weight of the thermosensitive coloring layer, the dynamic thermal coloring sensitivity of the thermosensitive coloring layer decreases.

In contrast to this invention, in a conventional thermo-sensitive recording sheet comprising a support material and a thermosensitive coloring layer formed thereon, the amount of a binder agent added to the thermosensitive coloring layer is in the range of as much as 15 wt. % to 30 wt. % of the total weight of the thermosensitive coloring layer.

As for the acidic material which serves to color the leuco dye when heat is applied thereto, it is preferable that the amount of the acidic material be in the range of 2 to 6 times by weight the amount of the leuco dye.

As the colorless or light colored leuco dye in the coloring layer, triphenylmethane-type leuco compounds, fluoran-type leuco compounds, phenothiazine-type leuco compounds, auramine-type leuco compounds and spiropyran-type leuco compounds, are preferably employed. The following are examples of those leuco compounds:

(1) Triphenylmethane-type leuco compound of the general formula

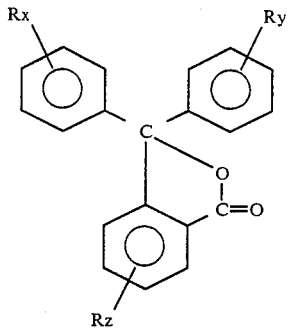

wherein $R_X$, $R_Y$ and $R_Z$ are individually hydrogen, a hydroxyl group, halogen, an alkyl group, a nitro group, an amino group, a dialkylamino group, monoalkylamino group or an aryl group.

Specific examples of the above compounds are as follows:

3,3-bis(p-diethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide
3,3-bis(p-dimethylaminophenyl)-6-chlorophthalide, and
3,3-bis(p-dibutylaminophenyl)-phthalide.

(2) Fluoran-type leuco compounds of the general formula

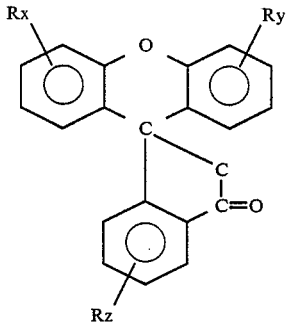

wherein $R_x$, $R_y$ and $R_z$ are individually hydrogen, a hydroxyl group, halogen, an alkyl group, a nitro group, an amino group, a dialkylamino group, a monoalkylamino group or an aryl group.

Specific examples of the above compounds are as follows:

3-cyclohexylamino-6-chlorofluoran,
3-(N,N-diethylamino)-5-methyl-7-(N,N-dibenzylamino) fluoran,
3-dimethylamino-5,7--dimethylfluoran,
3-diethylamino-7-methylfluoran, and
3-diethylamino-7,8-benzofluoran (3) Other fluoran-type leuco compounds including 3-diethylamino-6-methyl-7-chlorofluoran,
3-pyrrolidino-6-methyl-7-anilinofluroan,
2-(N-3-trifluoromethylphenyl)amino-6-diethyl-aminofluoran, and
2-[3,6-bis(diethylamino)-9-(o-chloroanilino) xanthylbenzoic acid lactam].

(4) Lactone compounds of the general formula

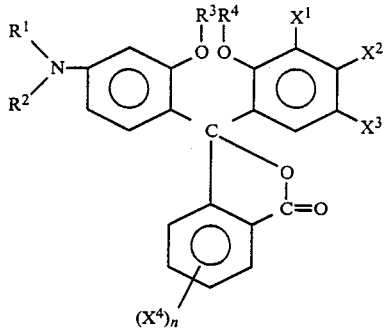

wherein $R^1$ and $R^2$ individually represent hydrogen, a lower alkyl, a substituted or unsubstituted aralkyl group, a substituted or unsubstituted phenyl group, a cyanoethyl group, or a α-halogenated ethyl group, or $R^1$ and $R^2$ in combination represent $—CH_2—_4$, $—CH_2—_5$, or $—CH_2—_2O—CH_2—_2$; $R^3$ and $R^4$ individually represent hydrogen, a lower alkyl group, an amino group or a phenyl group, and either $R^3$ or $R^4$ is hydrogen; $X^1$, $X^2$ and $X^3$ individually represent hydrogen, a lower alkyl group, a lower alkoxy group, halogen, a halogenated methyl group, a nitro group, or a substituted or unsubstituted amino group, $X^4$ represents hydrogen, halogen or a lower alkyl group or a lower alkoxy group; and n is an integer 0 to 4.

Specific examples of the above-mentioned compounds are as follows:

3-(2'-hydroxy-4'-dimethylaminophenyl)-3-(2'-methoxy-5'-chlorophenyl) phthalide, 3-(2'-hdyroxy-4'-dimethylaminophenyl)-3-(2'-methoxy-5'-nitrophenyl) phthalide, 3-(2'-hydroxy-440 -diethylaminophenyl)-3-(2'-methoxy-5'-methylphenyl) phthalide, and 3-(2'-methoxy-4'-dimethylaminophenyl)-3-(2'-hydroxy-4'-chloro-5'-methylphenyl) phthalide.

As the acidic materials for coloring the leuco dyes when heat is applied thereto, phenolic acidic materials, organic acids, and polyvalent metallic salts of organic carboxylic acids can be employed.

Specific examples of those acidic materials are as follows:

α-naphthol, α-naphthol, 4-t-butylphenol,
4-phenylphenol, 2,2'-bis(p-hydroxyphenyl) propane,
2,2'-bis(p-hydroxyphenyl) butane,
4,4'-cyclohexylidene diphenol,
4,4'-isopropylidene bis(2-t-butylphenol),
benzoic acid, salicylic acid, 3,5-di-t-butyl zinc salicylate,
3,5-di-t-butyl tin salicylate,
propyl-p-hydroxybenzoate,
benzyl-p-hydroxybenzoate.

The thermo-fusible material, which is not an indispensable component for the thermosensitive coloring layer, is added to the thermosensitive coloring layer in order to decrease the melting points of the coloring components, that is, the leuco dye and the acidic material, to the range from 70° C. to 120° C.

In the case where 3-diethylamino-o-chloroaniline fluoran is employed as a leuco dye, and benzyl-p-hydroxybenzoate (m.p. 109° C.) as an acidic material, a melting point measurement by use of a Differential Scanning Calorimeter (hereafter referred to as the DSC) indicated that the mixture of the two melted at 84° C. to 95° C. For this thermosensitive coloring system, thermo-fusible materials are unnecessary. In contrast to this, when the benzy-p-hydroxybenzoate was replaced by Bisphenol A in the above thermosensitive coloring system, the melting point of the mixture of the coloring components was measured to be in the range of 130° C. to 155° C. by use of the DSC. In this case, it is necessary to decrease the melting point of the coloring components, to about 70° C. to 80° C., for instance, by addition of stearamide thereto. Otherwise, the dynamic thermal coloring sensitivity of the thermosensitive coloring layer cannot be increased sufficiently for this invention.

As such thermo-fusible materials, higher fatty acid amides and derivatives thereof; higher fatty acid metallic salts; animal waxes and vegetable waxes; and petroleum waxes such as polyethylene, paraffin and microcrystalline, can be employed in the present invention.

As described above, the primer layer is formed on the base paper for the purpose of increasing the dynamic thermal coloring sensitivity of the thermosensitive coloring layer, and that purpose is in fact attained by the primer layer.

However, this alone does not improve the head-matching properties of the thermo-sensitive coloring layer. In order to eliminate the shortcomings of the conventional thermosensitive coloring layer in this regard, a protective layer comprising as the main component a water-soluble polymeric binder agent is formed on the thermosensitive coloring layer in the present invention.

As the water-soluble polymeric binder agent, for example, polyvinyl alcohol, cellulose ether, starch, ammonium polycarboxylates, and alkaline salts of isobutylene-maleic anhydride copolymer can be employed.

As the filler, inorganic fillers and organic fillers, which are conventionally employed for manufacturing paper or for coating paper, for example, calcium carbonate, clay, talc, silica, polystyrene resin, and urea-formaldehyde resin in the form of small particles, can be employed.

It is preferable that the amount of the water-soluble polymeric binder agent be in the range of 30 wt. % to 90 wt. % of the total weight of the protective layer, and the coating amount of the protective layer be in the range of 1 g/m² to 6 g/m². When the amount of the water-soluble polymeric binder agent is less than 30 wt. %, the binding force of the binder agent between the thermosensitive coloring layer and the protective layer becomes weak and the dynamic thermal coloring sensitivity of the thermosensitive coloring layer somehow decreases. On the other hand, when the amount of the water-soluble polymeric binder agent is more than 90 wt. %, sticking of the thermal pen or head to the thermosensitive recording sheet is apt to occur.

For further increase of the dynamic thermal coloring sensitivity of the thermosensitive coloring layer, and for further improvement of the thermal-head-matching properties, thermo-fusible materials such as higher fatty acid amides and derivatives thereof; higher fatty acid metallic salts; animal waxes and vegetable waxes; and petroleum waxes such as polyethylene, paraffin and microcrystalline, can be added to the protective layer, in an amount of not more than 20 wt. % of the total weight of the protective layer. Further, when necessary, aqueous emulsions of styrenebutadiene latex, of styrene-acrylic acid ester and of vinyl acetate can be employed together with the water-soluble polymeric binder agents.

By the above-described combination of the primer layer, the thermosensitive coloring layer and the protective layer, the dynamic thermal coloring sensitivity and the thermal-head-matching properties of the thermosensitive recording sheet according to the present invention are significantly improved as compared with those of the conventional thermosensitive recording sheets.

A thermosensitive recording sheet according to the present invention can be prepared as follows:

A primer layer coating liquid is prepared by mixing or by dispersing a filler, and a dispersion or emulsion of a binder agent.

Two thermosensitive coloring liquids are prepared separately, one for a leuco dye liquid and the other for an acidic material liquid. To each of the thermosensitive coloring liquids, an aqueous solution of a water-soluble polymer, such as polyvinyl alcohol, hydroxyethyl cellulose, alkali salts of styrene-maleic anhydride copolymers, or starch, is added. Each mixture is subjected to grinding in a grinding apparatus, for instance, in as a ball mill, an attritor or a sand mill, until the particles dispersed in the mixture are ground to particles with a size ranging from 1 μm to 3 μm. When necessary, a filler, a dispersion of a thermo-fusible material, or a defoaming agent, is added to each thermosensitive coloring liquid.

These thermosensitive coloring liquids are mixed to form a thermosensitive coloring layer liquid for forming a thermosensitive coloring layer.

A protective layer coating liquid is prepared by mixing or dispersing a filler, a thermo-fusible material and a water-soluble polymeric binder agent.

These coating liquids are successively coated on a sheet of conventional high quality paper to prepare a thermosensitive recording sheet according to the present invention.

The specific dynamic thermal coloring sensitivity of a thermosensitive recording sheet according to the present invention may be assessed as follows, as compared with the dynamic thermal coloring sensitivity of a conventional thermosensitive recording sheet consisting of a support material and a thermosensitive coloring layer.

Thermal printing was performed on the thermosensitive recording sheet according to the present invention by use of a thermal head for a facsimile apparatus, including a heat-emitting resistor with a resistance of about 300 ohms under the conditions that the main scanning recording speed was 20 ms/line, the scanning line density was 8 dots × 3.85 dots/mm, the platen pressure was 1.4 kg and the head voltage was 13 volts with a voltage application time of 1.88 msec.

The thus obtained image density measured more than 1.20 on a Macbeth densitometer RD-514 with a Wratten-106 filter. In contrast to this, the conventional thermosensitive recording sheet yielded an image density of 1.1 or less under the same thermal printing conditions as mentioned above. In the case of the conventional thermosensitive recording sheet, the thermosensitive recording sheet stuck to the thermal head during thermal recording.

In the case of the thermosensitive recording sheet according to the present invention, however, no materials which could adhere to the thermal head were produced during the printing process and therefore the thermosensitive recording sheet did not stick to the thermal head at all, unlike in the case of the conventional thermosensitive recording sheet.

Further, in the present invention, a back-coat layer comprising as the main component a water-soluble polymeric binder agent or an aqueous emulsion binder agent can be formed on the back side of the support material, opposite to the protective layer, in order to prevent the thermosensitive recording sheet from curling and to increase the solvent resisting properties of the thermosensitive recording sheet.

By referring to the following examples and comparative examples, specific embodiments of a thermosensitive recording sheet according to the present invention will now be explained.

EXAMPLE 1

A primer coating liquid was prepared by mixing the following components in an agitator:

| | Parts by Weight |
|---|---|
| 40% dispersion of calcium carbonate | 52.5 |
| 20% aqueous solution of starch | 17.5 |
| Styrene-butadiene latex (48%) | 7.3 |
| Water | 22.7 |

For preparation of a thermosensitive coloring liquid, Liquid A and Liquid B were prepared by grinding the following respective components in a ball mill until the particles in each liquid were about 1.5 μm in particle size:

| | Parts by Weight |
|---|---|
| Liquid A | |
| 3-(N—cyclohexyl-N—methyl) amino-6-methyl-7-anilinofluoran | 20.0 |
| 10% aqueous solution of polyvinyl alcohol | 16.0 |
| Water | 64.0 |
| Liquid B | |
| Benzyl-p-hydroxybenzoate | 10.0 |
| Calcium carbonate | 10.0 |
| 10% aqueous solution of polyvinyl alcohol | 16.0 |
| Water | 64.0 |

One part by weight of the Liquid A and 4 parts by weight of the Liquid B were mixed, so that a thermosensitive coloring liquid was prepared.

A protective layer liquid was prepared by dispersing the following components in a sand mill:

| | Parts by Weight |
|---|---|
| Calcium carbonate | 2.5 |
| 10% aqueous solution of polyvinyl alcohol | 65.0 |
| Zinc stearate | 1.0 |
| Water | 31.5 |

The primer layer coating liquid and the thermosensitive coloring liquid were successively coated on a sheet of high quality paper (50 g/m$^2$) by an air knife and a protective layer was coated thereon by a four-roller reverse coater in such a manner that the amount of each component in each layer, when dried, was as in Table 1.

TABLE 1

| Components | g/m² |
|---|---|
| Primer Layer | |
| Calcium carbonate | 3.0 |
| Starch | 0.5 |
| Styrene-butadiene | 0.5 |
| Thermosensitive Coloring Layer | |
| 3-(N—cyclohexyl-N—methyl) amino-6-methyl-7-anilino-fluoran | 0.5 |
| Benzyl-p-hydroxybenzoate | 2.0 |
| Polyvinyl alcohol | 0.2 |
| Calcium carbonate | 1.0 |
| Protective Layer | |
| Calcium carbonate | 0.5 |
| Polyvinyl alcohol | 1.3 |
| Zinc stearate | 0.2 |

The thus prepared thermosensitive recording sheet was subjected to super-calendering in such a manner that its luster was in the range of 10% to 13% as measured in accordance with Japanese Industry Standard P8142.

Thereafter, the dynamic coloring sensitivity and the thermal-head-matching properties of the thermosensitive recording sheet were determined by use of a thermal head capable of forming 8 dots/mm and with a heat-emitting resistor of about 300 ohm/dot, in a G-III facsimile apparatus, under the following two test conditions:

(1)
Main scanning recording speed: 20 ms/line
Subscanning: 3.85 l/mm
Platen pressure: 1.4 kg
Thermal head voltage: 13 V
Thermal head energized time: 1.88 msec (2)
Main scanning recording speed: 20 ms/line
Subscanning: 3.85 l/mm
Platen pressure: 1.4 kg
Thermal head voltage: 13 V
Thermal head energized time: 2.19 msec The extent of sticking of the thermosensitive recording sheet to the thermal head was assessed during thermal printing by use of an all-solid original under the above-mentioned second condition with a thermal head energizing time of 2.19 msec, and the generation of materials adhering to the thermal head during thermal printing was assessed by use of a checkered original (the white-to-black-area ratio was 50:50) also under the second condition.

The results were as follows:

| Dynamic Thermal Coloring Sensitivity | |
|---|---|
| 1.35 in 1.88 ms | |
| 1.39 in 2.19 ms | |
| Head-Matching Properties | |
| a. Sticking of the recording sheet to the thermal head | O |
| b. Production of sticky materials from the recording sheet during thermal printing | O |

O: almost none

EXAMPLE 2

A primer coating liquid, a thermosensitive coloring liquid, and a protective layer liquid were respectively prepared with the same formulations as the formulations of the liquids in Example 1, under the same conditions as in Example 1.

Those liquids were coated on a sheet of high quality paper (50 g/m²) in the same manner as in Example 1, except that the amount of each component in each layer was as in Table 2.

TABLE 2

| Components | g/m² |
|---|---|
| Primer Layer | |
| Calcium carbonate | 3.0 |
| Starch | 0.5 |
| Styrene-butadiene | 0.5 |
| Thermosensitive Coloring Layer | |
| 3-(N—cyclohexyl-N—methyl) amino-6-methyl-7-anilino-fluoran | 0.5 |
| Benzyl-p-hydroxybenzoate | 2.0 |
| Polyvinyl alcohol | 0.2 |
| Calcium carbonate | 1.0 |
| Protective Layer | |
| Calcium carbonate | 1.0 |
| Polyvinyl alcohol | 2.6 |
| Zinc stearate | 0.4 |

In this example, as compared with Example 1, only the coated amount of the protective layer was doubled.

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| Dynamic Thermal Coloring Sensitivity | |
|---|---|
| 1.27 in 1.88 ms | |
| 1.35 in 2.19 ms | |
| Head-Matching properties | |
| a. Sticking of the recording sheet to the thermal head | O |
| b. Production of sticky materials from the recording sheet during thermal printing | |

: None
O: almost none

COMPARATIVE EXAMPLE 1—1

The procedure of Example 1 was repeated, except that the primer layer was replaced by a primer layer in which the amount of each component was half of the amount of each component in Example 1 (refer to Table 1) when dried.

Calcium carbonate: 1.5 g/m²
Starch: 0.25 g/m²
Styrene-butadiene: 0.25 g/m²

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| Dynamic Thermal Coloring Sensitivity | |
|---|---|
| 1.10 in 1.88 ms | |
| 1.30 in 2.19 ms | |
| Head-Matching Properties | |
| a. Sticking of the recording | O |

-continued

| | |
|---|---|
| sheet to the thermal head | |
| b. Production of sticky materials from the recording sheet during thermal printing | O |

O: almost none

COMPARATIVE EXAMPLE 1-2

Example 1 was repeated except that the primer coating liquid employed in Example 1 was replaced by a primer coating liquid prepared by mixing the following components:

| | Parts by Weight |
|---|---|
| 40% aqueous dispersion of calcium carbonate | 70.5 |
| 20% aqueous solution of starch | 4.5 |
| Styrene-butadiene latex (48%) | 1.9 |
| Water | 23.1 |

The primer coating liquid, the thermosensitive coloring liquid and the protective layer coating liquid were successively coated on a sheet of high quality paper (50 g/m$^2$) in the same manner as in Example 1, except that the amount of each component in the primer coating liquid was as follows:

Calcium carbonate: 4.7 g/m$^2$

Starch: 0.15 g/m$^2$

Styrene-butadiene: 0.15 g/m$^2$

In this comparative example, the amount of the binder agent was less than 10 wt. % of the total weight of the primer layer.

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| | |
|---|---|
| Dynamic Thermal Coloring Sensitivity | |
| 1.10 in 1.88 ms | |
| 1.30 in 2.19 ms | |
| Head-matching-properties | |
| a. Sticking of the recording sheet to the thermal head | Δ |
| b. Production of sticky materials from the recording sheet during thermal printing | Δ |

Δ: observed, but slight

COMPARATIVE EXAMPLE 1-3

Example 1 was repeated except that the primer coating liquid employed in Example 1 was replaced by a primer coating liquid prepared by mixing the following components;

| | Parts by Weight |
|---|---|
| 40% aqueous dispersion of calcium carbonate | 27.7 |
| 20% aqueous solution of starch | 35.0 |
| Styrene-butadiene Latex (48%) | 14.6 |
| Water | 22.7 |

The primer coating liquid, the thermosensitive coloring liquid and the protective layer coating liquid were successively coated on a sheet of high quality paper (50 g/m$^2$) in the same manner as in Example 1, except the amount of each component in the primer coating liquid was as follows:

Calcium carbonate: 1.5 g/m$^2$

Starch: 1.0 g/m$^2$

Styrene-butadiene: 1.0 g/m$^2$

In this comparative example, the amount of the filler was less than 2.0 g/m$^2$, and the amount of the binder agent was more than 50 wt. % of the total weight of the primer layer.

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| | |
|---|---|
| Dynamic Thermal Coloring Sensitivity | |
| 1.12 in 1.88 ms | |
| 1.32 in 2.19 ms | |
| Head-Matching Properties | |
| a. Sticking of the recording sheet to the thermal head | O |
| b. Production of sticky materials from the recording sheet during thermal printing | O |

O : almost none

COMPARATIVE EXAMPLE 2-1

Example 2 was repeated except that no primer layer was formed.

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| | |
|---|---|
| Dynamic Thermal Coloring Sensitivity | |
| 1.05 in 1.88 ms | |
| 1.28 in 2.19 ms | |
| Head-Matching Properties | |
| a. Sticking of the recording sheet to the thermal head | O |
| b. Production of sticky materials from the recording sheet during thermal printing | |

: none

O: almost none

COMPARATIVE EXAMPLE 2—2

For preparation of a thermosensitive coloring liquid, Liquid A, which was the same as that employed in Example 1 and Example 2, and Liquid C were prepared by grinding the following respective components in a ball mill until the particles in each liquid were about 1.5 μm in particle size:

| | Parts by Weight |
|---|---|
| Liquid A | |
| 3-(N—cyclohexyl-N—methyl) amino-6-methyl-7-anilinofluoran | 20.0 |
| 10% aqueous solution of polyvinyl alcohol | 16.0 |
| Water | 64.0 |

-continued

| | Parts by Weight |
|---|---|
| Liquid C | |
| Benzyl-p-hydroxybenzoate acid | 10.0 |
| Calcium carbonate | 12.5 |
| Zinc stearate | 2.5 |
| 10% aqueous solution of polyvinyl alcohol | 12.5 |
| Water | 62.5 |

One part by weight of Liquid A, 8 parts by weight of Liquid C and 1.5 parts by weight of a 20% aqueous solution of starch were mixed, so that a thermosensitive coloring liquid was prepared.

This thermosensitive coloring liquid was directly coated on a sheet of high quality paper (50 g/m$^2$) by a coater in such a manner that the amount of each component in the thermosensitive coloring layer, when dried, was as in Table 3.

In this comparative example, neither a primer layer nor a protective layer was formed.

TABLE 3

| Components | g/m$^2$ |
|---|---|
| 3-(N—cyclohexyl-N—methyl) amino-6-methyl-7-anilino-fluoran | 0.5 |
| Benzyl-p-hydroxybenzoate | 2.0 |
| Polyvinyl alcohol | 0.24 |
| Calcium carbonate | 2.5 |
| Zinc stearate | 0.5 |
| Starch | 0.75 |

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| Dynamic Thermal Coloring Sensitivity | |
|---|---|
| 1.00 in 1.88 ms | |
| 1.25 in 2.19 ms | |
| Head-matching-properties | |
| a. Sticking of the recording sheet to the thermal head | O |
| b. Production of sticky materials from the recording sheet during thermal printing | O |

O: almost none

Example 3

A primer coating liquid was prepared by mixing the following components in an agitator:

| | Parts by Weight |
|---|---|
| 25% slurry of urea-formaldehyde resin particles | 40.0 |
| Styrene-butadiene latex (48%) | 10.4 |
| Water | 49.6 |

For preparation of a thermosensitive coloring liquid, Liquid A, which was the same as that employed in Example 1, and Liquid D were prepared by grinding the following respective components in a ball mill until the particles in each liquid were about 1.5 μm in particle size:

| | Parts by Weight |
|---|---|
| Liquid A | |
| 3-(N—cyclohexyl-N—methyl) amino-6-methyl-7-anilinofluoran | 20.0 |
| 10% aqueous solution of polyvinyl alcohol | 6.0 |
| Water | 54.0 |
| Liquid D | |
| Bisphenol A | 6.0 |
| Methylolstearamide | 3.0 |
| Calcium carbonate | 4.0 |
| 10% aqueous solution of polyvinyl alcohol | 19.2 |
| Water | 56.8 |

One part by weight of Liquid A and 5 parts by weight of Liquid D were mixed, so that a thermosensitive coloring liquid was prepared.

A protective layer liquid was prepared by dispersing the following components in a sand mill:

| | Parts by Weight |
|---|---|
| 25% slurry of urea-formaldehyde resin particles | 3.0 |
| 10% aqueous solution of polyvinyl alcohol | 60.0 |
| 12.5% aqueous solution of polyamide-epichlorohydrin | 3.0 |
| Zinc stearate | 1.0 |
| Water | 23.0 |

The primer layer coating liquid and the thermosensitive coloring liquid were successively coated on a sheet of high quality paper (50 g/m$^2$) by an air knife and a protective layer was coated thereon by a four-roller reverse coater in such a manner that the amount of each component in each layer, when dried, was as in Table 4.

TABLE 4

| Components | g/m$^2$ |
|---|---|
| Primer Layer | |
| Urea-formaldehyde resin filler | 4.0 |
| Styrene-butadiene | 1.5 |
| Thermosensitive Coloring Layer | |
| 3-(N—cyclohexyl-N—methyl) amino-6-methyl-7-anilino-fluoran | 0.5 |
| Bisphenol A | 2.0 |
| Methylolstearamide | 1.0 |
| Calcium carbonate | 0.5 |
| Polyvinyl alcohol | 0.28 |
| Protective Layer | |
| Urea-formaldehyde resin filler | 0.5 |
| Polyvinyl alcohol | 1.2 |
| Polyamide-epichlorohydrin | 0.2 |
| Zinc stearate | 0.2 |

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| Dynamic Thermal Coloring Sensitivity |
|---|

-continued

| | |
|---|---|
| 1.33 in 1.88 ms | |
| 1.40 in 2.19 ms | |
| Head-Matching Properties | |
| a. Sticking of the recording sheet to the thermal head | O |
| b. Production of sticky materials from the recording sheet during thermal printing | O |

O: almost none

EXAMPLE 4

A primer coating liquid, a thermosensitive coloring liquid, and a protective layer liquid were respectively prepared with the same formulations as the formulations of the liquids in Example 3, under the same conditions as in Example 3.

Those liquids were coated on a sheet of high quality paper (50 g/m$^2$) in the same manner as in Example 3, except that the amount of each component in each layer was as in Table 5.

TABLE 5

| Components | g/m$^2$ |
|---|---|
| Primer Layer | |
| Urea-formaldehyde resin filler | 4.0 |
| Styrene-butadiene | 1.5 |
| Thermosensitive Coloring Layer | |
| 3-(N—cyclohexyl-N—methyl) amino-6-methyl-7-anilino-fluoran | 0.5 |
| Bisphenol A | 2.0 |
| Methylolstearamide | 1.0 |
| Calcium carbonate | 0.5 |
| Polyvinyl alcohol | 0.28 |
| Protective Layer | |
| Urea-formaldehyde resin filler | 1.0 |
| Polyvinyl Alcohol | 2.4 |
| Polyamide-epichlorohydrin | 0.4 |
| Zinc stearate | 0.4 |

In this example, as compared with the Example 3, only the coating amount of the protective layer was doubled.

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| Dynamic Thermal Coloring Sensitivity | |
|---|---|
| 1.25 in 1.88 ms | |
| 1.37 in 2.19 ms | |
| Head-Matching Properties | |
| a. Sticking of the recording sheet to the thermal head | O |
| b. Production of sticky materials from the recording sheet during thermal printing | |

: none
O: almost none

COMPARATIVE EXAMPLE 3

Example 3 was repeated except that no protective layer was formed.

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| Dynamic Thermal Coloring Sensitivity | |
|---|---|
| 1.40 in 1.88 ms | |
| 1.42 in 2.19 ms | |
| Head-Matching Properties | |
| a. Sticking of the recording sheet to the thermal head | X |
| b. Production of sticky materials from the recording sheet during thermal printing | XX |

X: much
XX: greatest

In this comparative example, the dynamic thermal coloring sensitivity was rather high, but the head-matching-properties were too poor for practical use.

COMPARATIVE EXAMPLE 4

For preparation of a thermosensitive coloring liquid, Liquid A, which was the same as that employed in Example 1, and Liquid E were prepared by grinding the following respective components in a ball mill until the particles in each liquid were about 1.5 $\mu$ in particle size:

| | Parts by Weight |
|---|---|
| Liquid A | |
| 3-(N—cyclohexyl-N—methyl) amino-6-methyl-7-anilinofluoran | 20.0 |
| 10% aqueous solution of polyvinyl alcohol | 16.0 |
| Water | 64.0 |
| Liquid E | |
| Bisphenol A | 8.0 |
| Methylolstearamide | 8.0 |
| Zinc stearate | 2.0 |
| Calcium carbonate | 8.0 |
| 10% aqueous solution of polyvinyl alcohol | 18.0 |
| Water | 56.0 |

One part by weight of the Liquid A, 10 parts by weight of the Liquid E and 1.5 parts by weight of a 20% aqueous solution of starch were mixed, so that a thermosensitive coloring liquid was prepared.

This thermosensitive coloring liquid was directly coated on a sheet of high quality paper (50 g/m$^2$) by a coater in such a manner that the amount of each component in the thermosensitive coloring layer, when dried, was as in Table 6.

In this comparative example, neither a primer layer nor a protective layer was formed.

TABLE 6

| Components | g/m$^2$ |
|---|---|
| Thermosensitive Coloring Layer | |
| 3-(N—cyclohexyl-N—methyl) amino-6-methyl-7-anilino-fluoran | 0.5 |
| Bisphenol A | 2.0 |
| Methylolstearamide | 2.0 |
| Zinc stearate | 0.5 |
| Calcium carbonate | 2.0 |
| Polyvinyl alcohol | 0.49 |
| Starch | 0.75 |

The thus prepared thermosensitive recording sheet was subjected to super-calendering in the same manner as in Example 1, and, thereafter, the recording sheet was subjected to the same thermal printing tests as in Example 1 in order to determine its dynamic coloring sensitivity and thermal-head-matching properties.

The results were as follows:

| | |
|---|---|
| Dynamic Thermal Coloring Sensitivity | |
| 1.05 in 1.88 ms | |
| 1.30 in 2.19 ms | |
| Head-Matching Properties | |
| a. Sticking of the recording sheet to the thermal head | Δ |
| b. Production of sticky materials from the recording sheet during thermal printing | Δ |

Δ: observed, but slight

In the following table, the dynamic thermal coloring sensitivities and thermal-head-matching properties of the embodiments of a thermosensitive recording sheet according to the present invention and of the above-described comparative examples are summarized:

| | Dynamic Thermal Coloring Sensitivity | | Thermal-head-Matching Properties | |
|---|---|---|---|---|
| | 1.88 ms | 2.19 ms | Sticking | Production of Sticky Materials |
| Example 1 | 1.35 | 1.39 | o | o |
| Example 2 | 1.27 | 1.35 | o | |
| Example 3 | 1.33 | 1.40 | o | o |
| Example 4 | 1.25 | 1.37 | o | |
| Comparative Example 1-1 | 1.10 | 1.30 | o | o |
| Comparative Example 1-2 | 1.10 | 1.30 | Δ | Δ |
| Comparative Example 1-3 | 1.12 | 1.32 | o | o |
| Comparative Example 2-1 | 1.05 | 1.28 | o | |
| Comparative Example 2-2 | 1.00 | 1.25 | o | o |
| Comparative Example 3 | 1.40 | 1.42 | x | xx |
| Comparative Example 4 | 1.05 | 1.30 | Δ | Δ |

none; o almost none; Δ observed, but slight; x much; xx greatest.

As can be seen from the above, the embodiments of a thermosensitive recording sheet according to the present invention are excellent in dynamic thermal coloring sensitivity and thermal-head-matching properties, as compared with the comparative examples.

What is claimed is:

1. A thermosensitive recording sheet comprising:

a support material;

a primer layer formed on said support material, said primer layer comprising a first filler and a first binder agent;

a thermosensitive coloring layer formed on said primer layer, said thermosensitive coloring layer comprising a colorless or light-colored leuco dye, an acidic material which induces color formation in said leuco dye upon application of heat thereto, and a third binder in an amount in the range of from 3 wt. % to 10 wt. % of the total weight of said thermosensitive coloring layer; and a protective layer formed on said thermosensitive coloring layer, said protective layer comprising a water-soluble polymeric second binder agent and a second filler.

2. A thermosensitive recording sheet as claimed in claim 1, wherein the amount of said first filler in said primer layer is in the range of 2.0 g/m$^2$ to 30 g/m$^2$ and the amount of said first binder agent in said primer layer is in the range of 10 wt. % tp 50 wt. % of the total weight of said primer layer.

3. A thermosensitive recording sheet as claimed in claim 2, wherein the average particle size of said first filler is not more than 5 μm.

4. A thermosensitive recording sheet as claimed in claim 1, wherein sid thermosensitive coloring layer further comprises a third filler in an amount of not more than 3 times by weight the amount of said leuco dye 5. A thermosensitive recording sheet as claimed in claim 1, wherein the amount of said acidic material is in the range of 2 to 6 times by weight the amount of said leuco dye in said thermosensitive coloring layer.

6. A thermosensitive recording sheet as claimed in claim 1, wherein said first filler in said primer layer and said second filler in said protective layer are selected from the group consisting of calcium carbonate, clay, talc, silica, polystyrene and urea-formaldehyde resin.

7. A thermosensitive recording sheet as claimed in claim 1, wherein said first binder agent in said primer layer is selected from the group consisting of polyvinyl alcohol, cellulose ether, starch, ammonium polycarboxylates, alkaline salts of isobutylene-maleic anhydride copolymer, aqueous emulsions of styrene-butadiene latex, aqueous emulsions of styrene-acrylic acid ester, and aqueous emulsions of vinyl acetate.

8. A thermosensitive recording sheet as claimed in claim 1, wherein said colorless or light-colored leuco dye is selected from the group consisting of triphenylmethane-type leuco compounds, fluoran-type leuco compounds, phenothiazine-type leuco compounds, auramine-type leuco compounds and spiropyran-type leuco compounds.

9. A thermosensitive recording sheet as claimed in claim 1, wherein said acidic material is selected from the group consisting of organic acids and polyvalent metallic salts of organic carboxylic acids.

10. A thermosensitive recording sheet as claimed in claim 1, wherein said water-soluble polymeric second binder agent in said protective layer is selected from the group consisting of polyvinyl alcohol, cellulose ether, starch, ammonium polycarboxylates, and alkaline salts of isobutylene-maleic anhydride copolymer.

11. A thermosensitive recording sheet as claimed in claim 1, wherein said thermosensitive coloring layer further comprises a thermo-fusible material for decreasing the melting point of said leuco dye or of said acidic material or both.

12. A thermosensitive recording sheet as claimed in claim 10, wherein said thermo-fusible material is selected from the group consisting of higher fatty acid amides and derivatives thereof; higher fatty acid metallic salts; animal waxes; vegetable waxes and petroleum waxes.

13. A thermosensitive sheet as claimed in claim 1, wherein the amount of said water-soluble polymeric second binder agent in said protective layer is in the range of 30 wt. % to 90 wt. % of the total weight of said protective layer, and the coating amount of said protective layer is in the range of 1 g/m$^2$ to 6 g/m$^2$.

14. A thermosensitive recording sheet as claimed in claim 1, wherein said protective layer further comprises a thermo-fusible material in an amount of not more than 20 wt. % of the total weight of said protective layer.

15. A thermosensitive recording sheet as claimed in claim 14, wherein said thermo-fusible material is selected from the group consisting of higher fatty acid amides and derivatives thereof; higher fatty acid metallic salts; animal waxes and; vegetable waxes; and petroleum waxes.

16. A thermosensitive recording sheet as claimed in claim 1, wherein said protective layer further comprises an aqueous emulsion of a compound selected from the group consisting of styrene-butadiene latex, styrene-acrylic acid ester and vinyl acetate, in an amount of not more than 20 wt. % of the total weight of said protective layer.

17. A thermosensitive recording sheet comprising:

a support;

a primer layer formed on said support, said primer layer consisting essentially of 2 to 30 g/m$^2$ of a first filler in the form of particles having an average particle size not greater than 5 $\mu$m, and 10 to 50 wt. % of a first binder;

a thermosensitive coloring layer formed on said primer layer, said thermosensitive coloring layer consisting essentially of: an effective amount of a leuco dye, an acidic material capable of developing color in said leuco dye when heat is applied to said thermosensitive coloring layer, the amount of said acidic material being 2 to 6 times the amount of said leuco dye, 3 to 10 wt. % of a second binder, a first thermofusible material in an amount of from zero up to an amount effective to bring the melting point of said leuco dye and said acidic material present as a mixture thereof in said thermosensitive coloring layer to a selected value in the range of 70° C. to 120° C., and a second filler in an amount of from zero to 3 times by weight of the amount of said leuco dye; and a protective layer formed on said thermosensitive coloring layer in an amount of from 1–6 g/m$^2$, said protective layer consisting essentially of 30 to 90 wt. % of a water-soluble polymeric third binder, 0 to 20 wt. % of a second thermosfusible material, said second thermofusible material having the same properties as said first thermofusible material, and the balance is essentially a third filler.

* * * * *